US010631081B2

(12) United States Patent
Wheeler et al.

(10) Patent No.: US 10,631,081 B2
(45) Date of Patent: Apr. 21, 2020

(54) VENTING SYSTEM FOR VEHICLE SPEAKER ASSEMBLY

(71) Applicant: Harman International Industries, Inc., Stamford, CT (US)

(72) Inventors: Brandon Michael Wheeler, Wixom, MI (US); Christopher Ludwig, Birmingham, MI (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 15/525,362

(22) PCT Filed: May 4, 2016

(86) PCT No.: PCT/US2016/030700
§ 371 (c)(1),
(2) Date: May 9, 2017

(87) PCT Pub. No.: WO2016/179238
PCT Pub. Date: Nov. 10, 2016

(65) Prior Publication Data

US 2018/0063632 A1 Mar. 1, 2018

Related U.S. Application Data

(60) Provisional application No. 62/156,481, filed on May 4, 2015.

(51) Int. Cl.
*H04R 1/28* (2006.01)
*H04R 1/02* (2006.01)

(52) U.S. Cl.
CPC ..... *H04R 1/2826* (2013.01); *H04R 1/028* (2013.01); *H04R 1/2811* (2013.01); *H04R 1/02* (2013.01); *H04R 2499/13* (2013.01)

(58) Field of Classification Search
CPC ..... B60R 2011/0021; B60R 11/0223; H04R 2499/13
(Continued)

(56) References Cited

U.S. PATENT DOCUMENTS 4,085,289 A 4/1978 Schmideler
5,218,175 A 6/1993 Scarlata
(Continued)

FOREIGN PATENT DOCUMENTS

CN 104221399 A 12/2014
DE 19909143 A1 11/2000
(Continued)

OTHER PUBLICATIONS

Olson, H., Elements of Acoustical Engineering. 1940, D. Yan Nostrand Company Inc. pp. 60-69 and 127-133.*
(Continued)

*Primary Examiner* — Kile O Blair
(74) *Attorney, Agent, or Firm* — Brooks Kushman P.C.

(57) ABSTRACT

A venting system for a vehicle speaker assembly includes an internal enclosure provided within a first vehicle component and having the vehicle speaker assembly disposed therein, a vent provided in the internal enclosure, and a port provided in a second vehicle component, wherein engagement of the vent with the port allows for an output generated by the vehicle speaker assembly to be transmitted from the internal enclosure to the second vehicle component.

9 Claims, 5 Drawing Sheets

(58) Field of Classification Search
USPC ..... 381/345, 349, 351
See application file for complete search history.

(56) References Cited

U.S. PATENT DOCUMENTS

| | | | | |
|---|---|---|---|---|
| 6,354,651 | B1 | 3/2002 | Mori | |
| 6,868,937 | B2 | 3/2005 | Cass | |
| 6,955,241 | B2 | 10/2005 | Thorsell et al. | |
| 7,628,249 | B2 | 12/2009 | Hanna | |
| 8,044,413 | B2 | 10/2011 | Albus et al. | |
| 8,130,976 | B2 | 3/2012 | Linhard et al. | |
| 8,139,783 | B2 | 3/2012 | Schuster et al. | |
| 8,469,447 | B2 | 6/2013 | Baker | |
| 8,649,548 | B1 | 2/2014 | Weber et al. | |
| 8,708,092 | B2 | 4/2014 | Ito et al. | |
| 8,776,944 | B2 | 7/2014 | Ito et al. | |
| 8,804,991 | B2 | 8/2014 | Velican | |
| 8,837,762 | B2 | 9/2014 | Tada | |
| 8,837,768 | B2 | 9/2014 | Subat et al. | |
| 9,025,790 | B2 | 5/2015 | Tada | |
| 9,549,243 | B2 * | 1/2017 | Stys | H04R 1/2884 |
| 9,820,033 | B2 | 11/2017 | Dix et al. | |
| 2001/0030078 | A1 | 10/2001 | Jones et al. | |
| 2003/0183444 | A1 | 10/2003 | Cass | |
| 2003/0215101 | A1 | 11/2003 | Stuart et al. | |
| 2004/0141625 | A1 * | 7/2004 | Leipold | B60R 11/0217 381/86 |
| 2004/0202337 | A1 | 10/2004 | Jun | |
| 2005/0100173 | A1 | 5/2005 | Eid et al. | |
| 2005/0218694 | A1 | 10/2005 | Schoemann et al. | |
| 2006/0151910 | A1 | 7/2006 | Schoemann et al. | |
| 2007/0154055 | A1 | 7/2007 | Nichols et al. | |
| 2008/0101646 | A1 | 5/2008 | Holmi | |
| 2008/0240474 | A1 | 10/2008 | Sakamoto et al. | |
| 2009/0110210 | A1 | 4/2009 | Ludwig et al. | |
| 2009/0154726 | A1 | 6/2009 | Taenzer | |
| 2009/0220112 | A1 | 9/2009 | Fincham | |
| 2011/0142251 | A1 | 6/2011 | Rosen | |
| 2012/0106748 | A1 | 5/2012 | Peachey et al. | |
| 2012/0219171 | A1 | 8/2012 | Velican | |
| 2013/0188806 | A1 | 7/2013 | Tada | |
| 2013/0272537 | A1 | 10/2013 | Tada et al. | |
| 2013/0284536 | A1 | 10/2013 | Ito et al. | |
| 2014/0055258 | A1 | 2/2014 | Grosse-Budde | |
| 2014/0270270 | A1 | 9/2014 | Ito | |
| 2015/0030178 | A1 | 1/2015 | Sulowski | |
| 2015/0036840 | A1 | 2/2015 | Sulowski et al. | |
| 2015/0098586 | A1 | 4/2015 | Tanabe | |
| 2016/0016513 | A1 | 1/2016 | Di Censo et al. | |

FOREIGN PATENT DOCUMENTS

| | | | | | |
|---|---|---|---|---|---|
| DE | 102008015490 | A1 | | 10/2009 | |
| DE | 102011105474 | A1 | | 12/2012 | |
| DE | 202013105629 | A1 | | 7/2014 | |
| DE | 102013020672 | A1 | | 8/2014 | |
| EP | 0904985 | A1 | | 3/1999 | |
| EP | 1266799 | A1 | | 12/2002 | |
| EP | 1407934 | A1 | | 4/2004 | |
| EP | 1773092 | A2 | | 4/2007 | |
| EP | 2043382 | A1 | | 4/2009 | |
| EP | 2077680 | A1 | | 7/2009 | |
| EP | 2211562 | A1 | | 7/2010 | |
| EP | 2530835 | A1 | | 12/2012 | |
| EP | 2654319 | A2 | | 10/2013 | |
| EP | 2858377 | A1 | | 4/2015 | |
| JP | 62287296 | A | * | 11/1988 | |
| JP | 07267003 | A | * | 10/1995 | B60J 5/0477 |
| JP | 07304398 | A | * | 11/1995 | |
| JP | H07304398 | A | | 11/1995 | |
| JP | 08253082 | A | * | 10/1996 | |
| JP | H08-253082 | A | | 10/1996 | |
| JP | 2002240643 | A | | 8/2002 | |
| JP | 2007106281 | A | | 4/2007 | |
| JP | 2007267003 | A | | 10/2007 | |
| JP | 2012121455 | A | | 6/2012 | |
| JP | 2013229730 | A | | 11/2013 | |
| WO | 2016123360 | A1 | | 8/2016 | |

OTHER PUBLICATIONS

Gettleman et al., "Boys who died lived 17 hours in car trunk, lawyer says", pp. 1-4, Jul. 19, 2005, https://www.nytimes.com/2005/07/18/nyregion/boys-who-died-lived-17-hours-in-car-trunk-lawyer-says.html.

DIYmobileaudio, "another infinite baffle thread," pp. 1-32, Oct. 4, 2011, https://www.diymobileaudio.com/forum/build-logs-project-install-gallery/115050-another-infinite-baffle-thread-3-12s-2007-honda-accord.html.

XC90 Bowers and Wilkins Premium Sound Master, https://vimeo.com/149821145, Dec. 22, 2015.

Don beyer volvo, https://donbeyervolvoxc90.com/audiosystems/, Oct. 13, 2014.

* cited by examiner

VENTING SYSTEM FOR VEHICLE SPEAKER ASSEMBLY

CROSS-REFERENCE TO RELATED APPLICATION

This application is the U.S. national phase of PCT Application No. PCT/US2016/030700 filed on May 4, 2016, which claims the benefit of U.S. provisional application Ser. No. 62/156,481 filed May 4, 2015, the disclosures of which are incorporated in their entirety by reference herein.

TECHNICAL FIELD

Embodiments relate to a venting system for a vehicle speaker assembly.

BACKGROUND

In vehicles, speakers are often housed in large enclosures that take up significant space and add unnecessary weight. In addition, weak sheet metal or trim pieces in the vehicle may fail to completely seal off the rear wave of a speaker driver from the interior of the vehicle, thus degrading the sound quality produced.

SUMMARY

In one embodiment, a venting system for a vehicle speaker assembly includes an internal enclosure provided within a first vehicle component and having the vehicle speaker assembly disposed therein, a vent provided in the internal enclosure, and a port provided in a second vehicle component, wherein engagement of the vent with the port allows an output generated by the vehicle speaker assembly to be transmitted from the internal enclosure to the second vehicle component.

In another embodiment, a venting system for a vehicle speaker assembly includes an internal enclosure provided within a first vehicle component and having the vehicle speaker assembly disposed therein, a vent provided in the internal enclosure, and a port provided in a second vehicle component. A channel is connected to the port and extends through the second vehicle component to an exterior of the second vehicle component, wherein engagement of the vent with the port allows a rear wave generated by the vehicle speaker assembly to be transmitted from the internal enclosure through the channel to the exterior of the second vehicle component.

In another embodiment, a venting system for a vehicle speaker assembly includes an internal enclosure provided within a first vehicle component and having the vehicle speaker assembly disposed therein, a vent provided in the internal enclosure, and a port provided in a second vehicle component. An external enclosure is connected to the port and contained within the second vehicle component, wherein engagement of the vent with the port allows a rear wave generated by the vehicle speaker assembly to be transmitted from the internal enclosure to the external enclosure.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Embodiments disclosed herein include a venting system for a vehicle speaker assembly housed within a first vehicle component, where the venting system provides for an improved seal with the vehicle trim to reduce sound distortion. A speaker assembly is provided within a relatively small internal enclosure packaged in a vehicle lift gate or door, for example, where the enclosure includes a vent which engages and may seal with a port within a second vehicle component, such as a vehicle bumper or door sill, in order to vent output, such as a rear wave, generated by the speaker assembly. This venting will decouple the front wave and rear wave of the speaker assembly within the interior cabin of the vehicle, and help to create optimal performance of the speaker driver when door sheet metal or door trim is not rigid enough to help the back pressure from the speaker transducer. By venting the rear wave, less pressure is created on the vehicle trim pieces and optimal phase alignment is facilitated due to no rear phase exposure inside the vehicle. As a result, unwanted noise is reduced in the vehicle, and the small internal enclosure provides a more efficient use of space in the vehicle and reduces overall weight while still achieving the desired output characteristics.

Figure 1:
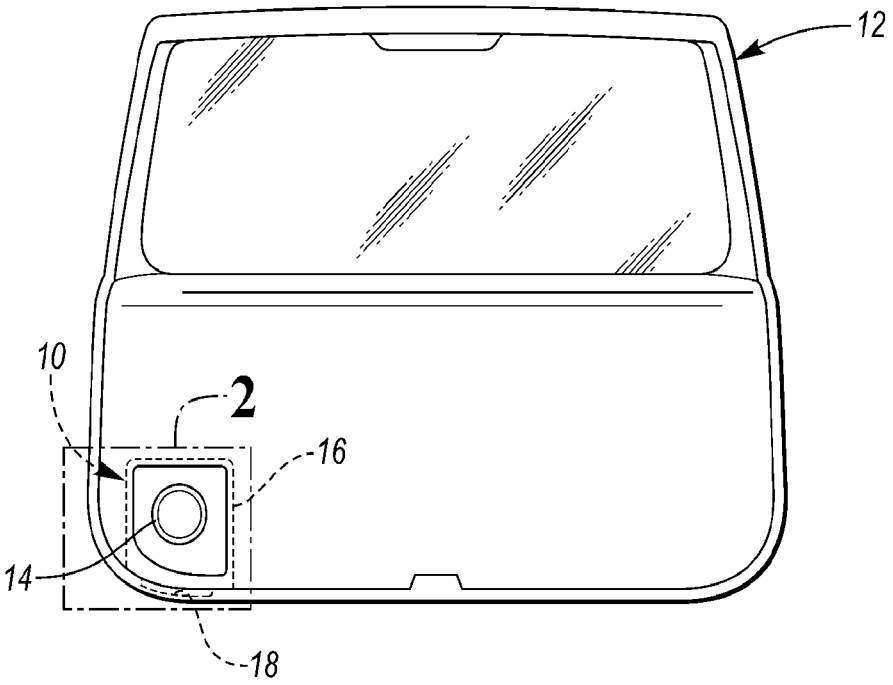
FIG. 1 is an interior front view of a vehicle lift gate having a venting system for a speaker assembly according to an embodiment.
Figure 2:
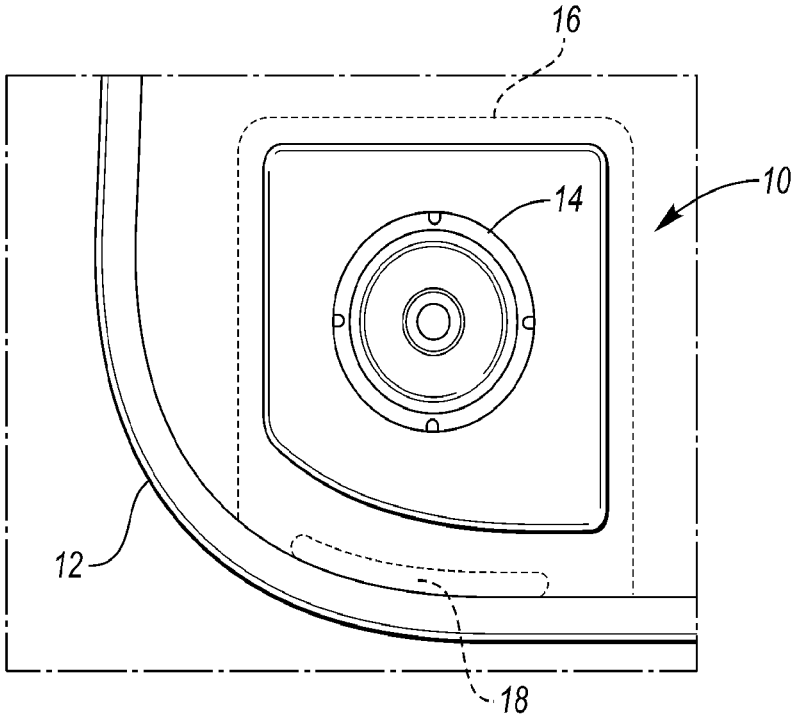
FIG. 2 is an enlarged view of a speaker assembly and enclosure in a vehicle lift gate.
Figure 3:
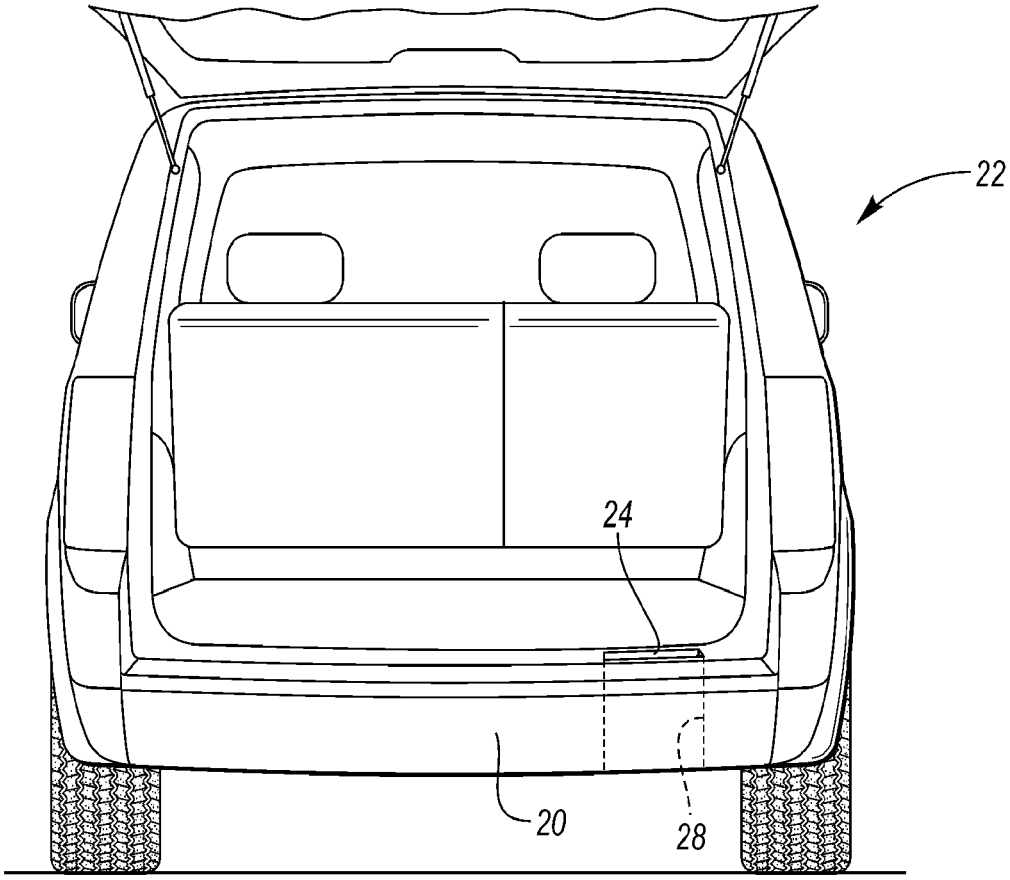
FIG. 3 is an exterior view of an engaged vent and port of a venting system according to an embodiment.
Figure 4:
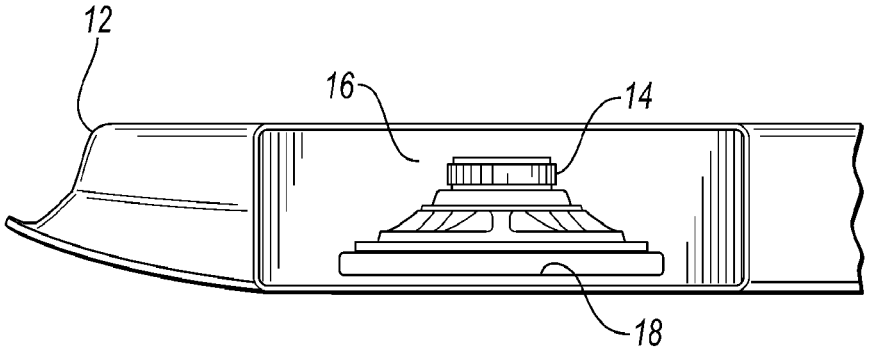
FIG. 4 is a bottom view of a vehicle lift gate illustrating the speaker assembly and enclosure vent.

Turning first to FIGS. 1-4, an interior front view of a venting system 10 within a first vehicle component, such as vehicle lift gate 12, is illustrated according to an embodiment. As shown, a speaker assembly 14 is provided in an internal enclosure 16, where the speaker assembly 14 is operable to transmit sound into an interior of the vehicle cabin, such as via a grill on the interior vehicle trim. The internal enclosure 16 includes a vent 18 which cooperates with a second vehicle component, such as a bumper 20. While a particular location of the speaker assembly 14, the internal enclosure 16 and the vent 18 are depicted, it is understood that other locations within the lift gate 12 and vehicle trim are also contemplated. FIG. 3 shows an exterior view of a vehicle 22, illustrating a port 24 within the bumper 20 for cooperating with the vent 18 when the lift gate 12 is closed to allow the transmitting of output from the speaker assembly 14, such as the rear wave, from the internal enclosure 16 to the bumper 20. FIG. 4 is a bottom view of a vehicle lift gate 12 illustrating the speaker assembly 14 and enclosure vent 18. In one embodiment, a channel 28 may be connected to the port 24 and extend through the bumper 20 to an exterior of the bumper 20, thus venting to the outside atmosphere. Although a generally rectangular channel 28 is shown, it is understood that the channel 28 can have any configuration suitable to vent the output of the speaker assembly 14. Furthermore, the channel 28 may be designed with different selected lengths, which will tune the actual resonance and driver output of the speaker assembly 14.

In the embodiments described herein, the internal enclosure 16 may be efficiently sized with respect to the size of the speaker assembly 14 and the maximum movement area of the speaker assembly 14. For example, in one non-limiting embodiment, the internal enclosure 16 may have a volume which is between about 5%-25% larger, or more particularly between about 10%-20% larger, than the volume required to house and operate the speaker assembly 14. The vent 18 and the port 24 may be approximately equal in size and shape for effective engagement, and are not limited to the generally rectangular configuration depicted herein. In addition, the vent 18 and the port 24 may each have an area or ratio with respect to the volume of the internal enclosure 16 that is large enough so as not to lower the performance of the driver of the speaker assembly 14.

Figure 5:
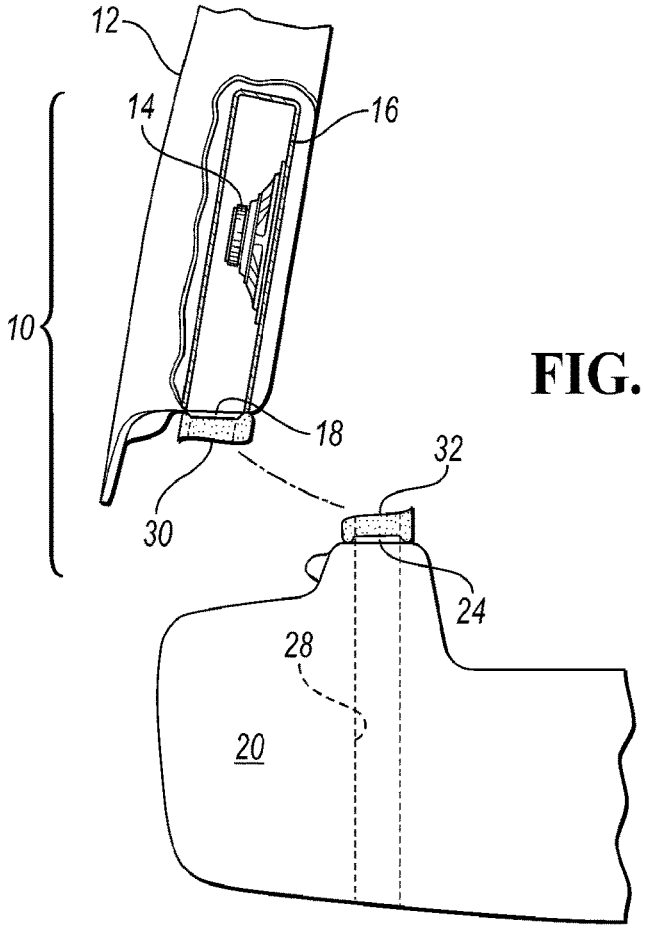
FIG. 5 is a side cross-sectional view of a vehicle lift gate in an open position with respect to the vehicle bumper.
Figure 7:
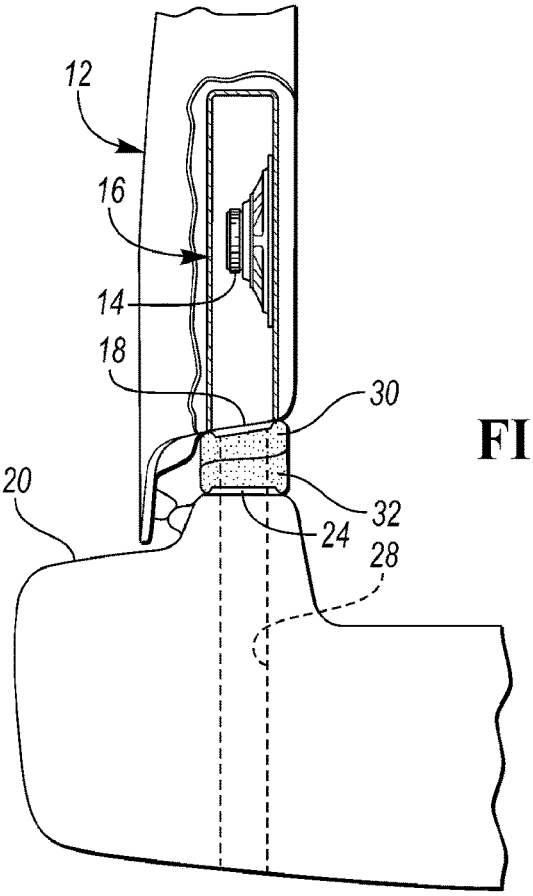
FIG. 7 is a cross-sectional view of the vehicle lift gate engaged with the vehicle bumper.

FIG. 5 is a side cross-sectional view of the vehicle lift gate 12 in an open position with respect to the vehicle bumper 20. A vent gasket 30 may be provided surrounding the vent 18, and a port gasket 32 may be provided surrounding the port 24, where each gasket 30, 32 may be constructed from a rubber material. The vent gasket 30 may be attached, such as by appropriately torqued screws, to the vent 18 to provide a proper seal from the interior of the vehicle 22. Likewise, the port gasket 32 may be attached to the port 24, such that the gaskets 30, 32 have a two-part configuration. Alternatively, the gasket or seal may comprise a single part that attaches to either the lift gate 12 or the bumper 20, depending on the lift gate 12 angle when mating with the bumper 20. In this way, the vent 18 and the port 24 may engage or mate with a seal to create isolation from the interior of the vehicle cabin. FIG. 7 is a cross-sectional view of a vehicle lift gate 12 in a closed position with respect to the vehicle bumper 20 which illustrates an embodiment where a vent gasket 30 and a port gasket 32 having complementary shapes are provided on the lift gate 12 and the bumper 20, respectively, to create a seal for allowing the output (e.g., rear wave) of the speaker assembly 14 to be transmitted from the internal enclosure 16 to the bumper 20.

Figure 6:
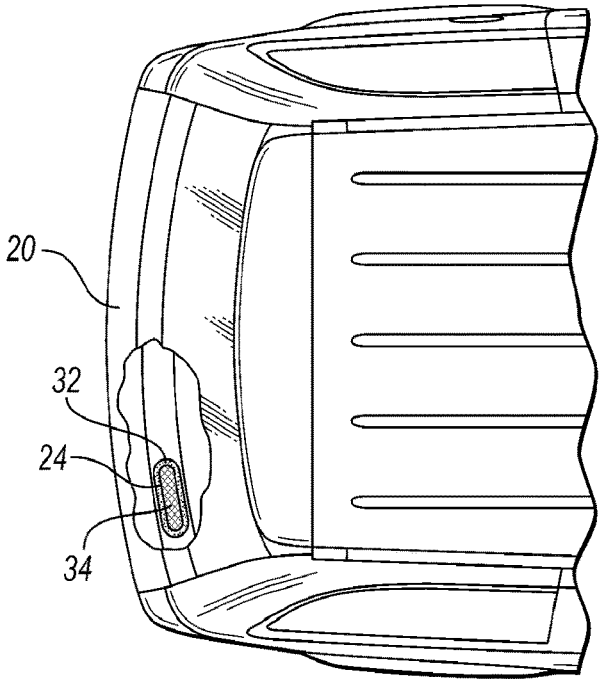
FIG. 6 is a top view of a port including a grill.

A top view of the port 24 is shown in FIG. 6, where a grill 34 may be provided covering the port 24 so as to prevent any smaller items from falling into the port 24. Likewise, the vent 18 could also be provided with a grill (not shown). The grill 34 can be constructed from plastic or any other suitable material. In one embodiment, the grill 34 may have an open area of at least about 75% so as to not cause impedance of the air path venting from the speaker assembly 14.

Figure 8:
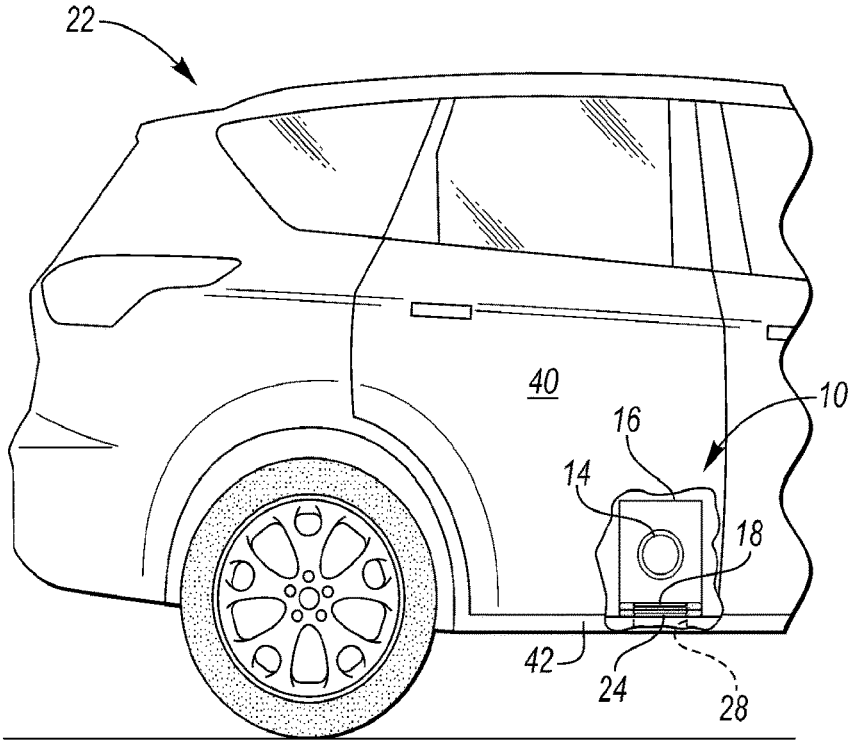
FIG. 8 illustrates an exterior view of a vehicle door having a venting system for a speaker assembly, including a vent and an engaged port according to an embodiment.
Figure 9:
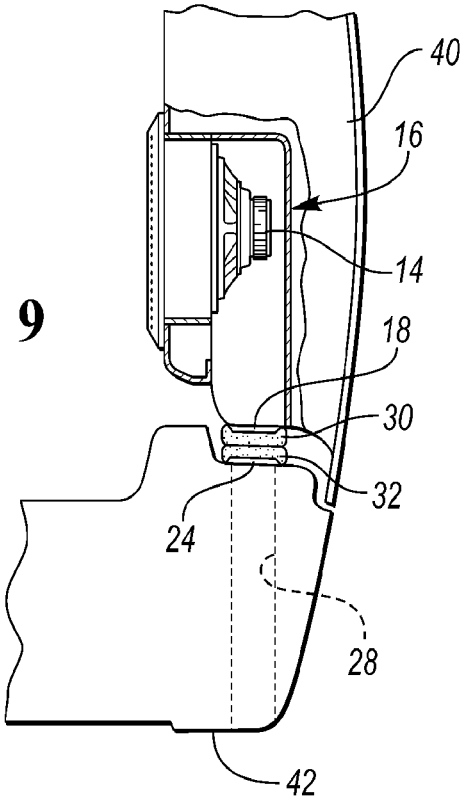
FIG. 9 is a cross-sectional view of the speaker assembly and enclosure within a vehicle door engaged with the vehicle door sill.

With reference now to FIGS. 8-9, an embodiment is illustrated wherein a venting system 10 similar to that described above is provided in a first vehicle component including a vehicle door 40 and a second vehicle component including a door sill 42. It is understood that the features for the venting system 10 embodiment for a lift gate 12 and bumper 20 as shown in FIGS. 1-7 are also applicable to the embodiment in the vehicle door 40 and door sill 42. In this latter embodiment, the speaker assembly 14 is provided in an internal enclosure 16 which includes a vent 18 provided on the bottom or other suitable location on the vehicle door 40, and the port 24 is provided on the door sill 42 or other suitable portion of the vehicle body for transmitting output from the speaker assembly 14 out of the internal enclosure 16. As above, while a particular location of the speaker assembly 14, the internal enclosure 16, the vent 18 are depicted, it is understood that other locations within the door 40 and vehicle trim are also contemplated.

In one embodiment, a channel 28 may extend from the port 24 through the door sill 42 to vent to the outside atmosphere. The port 24 can have any suitable configuration for venting the output of the speaker assembly 14, and may have any length appropriate for tuning the resonance and driver output of the speaker assembly 14. The internal enclosure 16 may be designed with a relative volume with respect to the speaker assembly 14 as described above, and the vent 18 and port 24 may be designed with an area or ratio with respect to the volume of the internal enclosure 16 as described above. Likewise, a vent gasket 30, port gasket 32, and grill 34 may be constructed and utilized in a similar manner with respect to the vehicle door 40 and door sill 42 as is described above for the lift gate 12 and bumper 20. With particular reference to the cross-sectional view of FIG. 9, when the vehicle door 40 is engaged with the door sill 42, a seal may be created between the vent 18 and the port 24 to allow the rear wave pressure from the speaker assembly 14 to escape from the internal enclosure 16 to the exterior of the vehicle 22.

Figure 10:
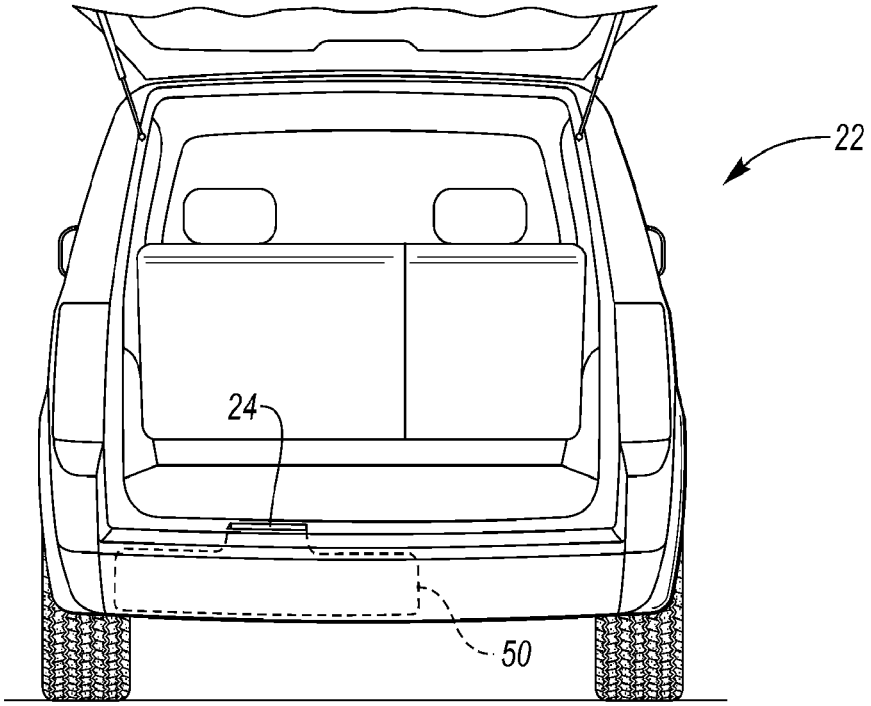
FIG. 10 is an exterior view of an external enclosure within the bumper according to an embodiment.

In an alternative embodiment depicted in FIG. 10, instead of a channel 28 extending to an exterior of the vehicle 22, an external enclosure 50 may be connected to the port 24 and contained with the second vehicle component, such as the bumper 20 or door sill 42, where the external enclosure 50 may have any suitable configuration or location therein. As was the case for the channel 28, output from the internal enclosure 16 can be transmitted via engagement of the vent 18 and the port 24 to the external enclosure 50. In one embodiment, the external enclosure 50 has a larger volume than the internal enclosure 16. The volume of the external enclosure 50 should have a volume that is of large enough area or ratio with respect to the volume of the internal enclosure 16 so as not to lower the performance of the driver of the speaker assembly 14.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A venting system for a vehicle speaker assembly in a vehicle, comprising:

an internal enclosure provided within a first vehicle component and having the vehicle speaker assembly disposed therein;

a vent provided in the internal enclosure;

a port provided in a second vehicle component; and a channel connected to the port and having walls extending through the second vehicle component to an exterior of the vehicle, wherein engagement of the vent with the port allows a rear wave generated by the vehicle speaker assembly to be transmitted from the internal enclosure through the channel to the exterior of the vehicle.

2. The venting system of claim 1, further comprising a vent gasket surrounding the vent and a port gasket surrounding the port, wherein the vent gasket and the port gasket have complementary shapes.

3. The venting system of claim 1, wherein the first vehicle component includes a lift gate and the second vehicle component includes a bumper.

4. The venting system of claim 1, wherein the first vehicle component includes a door and the second vehicle component includes a door sill.

5. The venting system of claim 1, further comprising at least one of a vent gasket surrounding the vent and a port gasket surrounding the port.

6. The venting system of claim 1, further comprising a grill covering the port.

7. The venting system of claim 6, wherein the grill has an open area of at least 75%.

8. The venting system of claim 1, wherein the channel is generally rectangular.

9. A venting system for a vehicle speaker assembly in a vehicle, comprising:

an internal enclosure provided within a first vehicle component and having the vehicle speaker assembly disposed therein;

a vent provided in the internal enclosure;

a port provided in a second vehicle component; and a channel connected to the port and having walls extending through the second vehicle component to an exterior of the vehicle, wherein the vent, the port and the channel all have substantially equal cross-sectional areas, and the channel has a length selected to tune an actual resonance and driver output of the vehicle speaker assembly, wherein engagement of the vent with the port allows a rear wave generated by the vehicle speaker assembly to be transmitted from the internal enclosure through the channel to the exterior of the vehicle.

* * * * *